US007172664B2

(12) United States Patent
Davisson et al.

(10) Patent No.: US 7,172,664 B2
(45) Date of Patent: Feb. 6, 2007

(54) METHOD OF MAKING ALUMINUM FOIL FOR FINS

(75) Inventors: Thomas L. Davisson, Chardon, OH (US); Luc Montgrain, Terre Haute, IN (US); Sadashiv Nadkarni, Lexington, MA (US)

(73) Assignee: Novelis Inc., Toronto (CA)

( * ) Notice: Subject to any disclaimer, the term of this patent is extended or adjusted under 35 U.S.C. 154(b) by 278 days.

(21) Appl. No.: 10/297,941

(22) PCT Filed: Jul. 4, 2001

(86) PCT No.: PCT/CA01/00965

§ 371 (c)(1),
(2), (4) Date: Apr. 10, 2003

(87) PCT Pub. No.: WO02/04690

PCT Pub. Date: Jan. 17, 2002

(65) Prior Publication Data

US 2003/0183309 A1 Oct. 2, 2003

Related U.S. Application Data

(60) Provisional application No. 60/216,399, filed on Jul. 6, 2000.

(51) Int. Cl.
*C22F 1/04* (2006.01)

(52) U.S. Cl. ..... 148/551; 148/695

(58) Field of Classification Search ..... 148/551, 148/552, 695, 696

See application file for complete search history.

(56) References Cited

U.S. PATENT DOCUMENTS 4,737,198 A 4/1988 Shabel et al. ..... 148/2
5,466,312 A 11/1995 Ward, Jr. et al. ..... 148/551
5,554,234 A 9/1996 Takeuchi et al. ..... 148/551

FOREIGN PATENT DOCUMENTS

| | | |
|---|---|---|
| JP | 04325643 | 11/1992 |
| JP | H5--51710 | 3/1993 |
| JP | 06093396 | 4/1994 |
| JP | 06093397 | 4/1994 |
| JP | 06101003 | 4/1994 |
| JP | 07041919 | 2/1995 |
| WO | WO 9845492 A1 * | 10/1998 |

OTHER PUBLICATIONS

"ASM Handbook: vol. 4 Heat Treating", ASM International, 1991, p. 539.*
"Metals Handbook: Desk Edition", 2nd ed., ASM International, 1998, p. 448.*
"ASM Handbook: vol. 4 Heat Treating", ASM International, 1991, p. 870, 872.*

* cited by examiner

*Primary Examiner*—George Wyszumierski
*Assistant Examiner*—Janelle Morillo

(57) ABSTRACT

A method is described for making an aluminum alloy foil suitable for application to fins used in heat exchangers. The method comprises providing an aluminum alloy composition containing about 0.27% to about 0.55% by weight of iron, about 0.06% to about 0.55% by weight of silicon and optionally up to about 0.20% by weight of copper; continuously casting a coiled strip from the molten aluminum alloy; cold rolling the continuously cast coil to a final gauge of about 0.076 mm to about 0.152 mm and partially annealing the aluminum alloy sheet at a temperature below about 260° C., with a maximum overheat of about 10° C. to anneal the aluminum alloy foil substantially without any recrystallization.

6 Claims, No Drawings

METHOD OF MAKING ALUMINUM FOIL FOR FINS

CROSS REFERENCE TO RELATED APPLICATION

This application claims the benefit of U.S. Provisional Application Ser. No. 60/216,399, filed Jul. 6, 2000.

TECHNICAL FIELD

The present invention describes a method of fabricating an aluminum foil suitable for application in fins used in heat exchangers, particularly for condenser and evaporator coils.

BACKGROUND ART

Aluminum foils are popularly used in heat exchangers because aluminum has very high thermal conductivity. These fins are typically fitted over copper tubes and mechanically assembled. As the size of the air conditioner units increases, the fins become longer, and it is important that they have sufficient strength so that they can be lifted without bending. Low strength can also result in handling damage when the coils are bent to form a unit. One way to improve the rigidity of the coil is to increase the gauge of the aluminum foil. Since this alternative is costly, and adds weight, air conditioner manufacturers prefer to use stronger foil.

The most popular alloy used in this application is the alloy AA 1100. It has the composition shown in Table I below:

TABLE I

| Elements | Wt |
|---|---|
| Silicon + Iron: | <0.95 |
| Copper: | 0.05–0.20 |
| Aluminum: | >99.00 |
| Other elements: | <0.05 |

When fully annealed, this alloy has very low strength. For example, typical yield strength could be between 20.7–41.4 MPa (3–6 ksi), and ultimate tensile strength (UTS) could be between 96.5–110.3 MPa (14–16 ksi). This alloy is highly formable, with elongation generally exceeding 24% and Olsen values above 0.25 in. (6 mm). If the formability is inadequate, the collars formed in this sheet through which the copper tubes are passed can crack in the reflare or in the body of the collar itself. These cracks are undesirable because the copper tubes, after passing through the fins, are expanded to form a good joint between the collar and the tube. If the collar is cracked, heat transfer between the fin and the tube deteriorates. "0" temper, AA 1100 sheet forms excellent collars and is popularly used in this application. A problem arises when higher strength is desired in applications such as long fins.

Typically, AA 1100 alloy formed by direct casting or DC method, hot rolled and then cold rolled to the final gauge of 0.1–0.13 mm (0.004–0.005 in), can be partially annealed. The partial anneal step involves heating the cold rolled sheet at temperatures between 240–270° C. During this time, the strength of the cold rolled sheet decreases and its formability increases. The cold rolling destroys the aluminum structure completely. When it is heated, the first step involves recovery and the second step involves recrystallization. In a typical anneal, the step of recovery involves a gradual reduction in strength while recrystallization involves precipitous decline in strength. The typical desired mechanical properties of a partially annealed sheet are shown in Table II below:

TABLE II

| | |
|---|---|
| Yield strength (MPa) | 96.5–110.3 |
| Elongation (%) | 20–24 |
| UTS (MPa) | 110.3–124.1 |

The partially annealed material has a structure that is fully recovered and has started forming some initial grains (incipient recrystallization). These grains are small, typically less than 25 micron in diameter. This material performs extremely well in fin application with collar cracks generally below 5%.

DC casting method, however, is expensive. In recent years, there has been a trend to go to continuous casting, using belt casters, roll casters, or other similar equipment. Continuous casters produce an "as-cast" strip that is less than 30 mm in thickness (more generally less than 25 mm in thickness). Roll casters generally produce a strip of 6 mm or less that can be directly cold rolled. Belt casters produce strip that can be either directly cold rolled or may be used in conjunction with an in-line rolling mill that reduces the thickness of the as cast slab, after it is solidified but before it cools, to a thickness suitable for cold rolling. The hot rolling step in DC cast material is preceded by a preheat (homogenization) at around 500° C. This homogenization step is not present in continuous casting method, and thus the thermal history of the two materials is significantly different. As a result, DC cast AA 1100 material produces excellent partially annealed sheet, whereas the corresponding continuous caster (CC) cast sheet has so far failed to give the desired performance. CC cast material is less formable than DC cast material at equivalent strength. Attempts to improve the formability (as characterized by elongation and Olsen values) by increasing the anneal temperature results in reduction of yield strength significantly below the lower limit of 89.6–96.5 MPa.

Various studies and previous attempts have been made to develop improved methods of making aluminum foils utilizing a single roll continuous casting method and an aluminum based alloy composition which can be single roll cast, homogenized, cold rolled and annealed to produce an aluminum foil product. For example, U.S. Pat. No. 5,466,312 (Ward, Jr.) discusses a method of making an aluminum foil which comprises providing a molten aluminum-based alloy consisting essentially of about 0.08 to 0.20 weight percent silicon, about 0.24 to 0.50 weight percent iron, and about 0.21 to 0.30 weight percent copper, with the balance being aluminum and inevitable impurities. The aluminum alloy composition is continuously cast to form a coiled cast strip. The coiled cast strip is homogenized, cold rolled, and followed by a final recrystallizing annealing step of 450–650° F. This temperature range creates recrystallization in the foil.

U.S. Pat. No. 5,554,234 (Takeuchi) proposes high strength aluminum alloy suitable for use in the manufacture of a fin. According to the patent, the aluminum alloy contains at most 0.1% by weight of silicon, 0.10 to 1.0% by weight of iron, 0.1 to 0.50% by weight of manganese, 0.01 to 0.15% by weight of titanium, with the balance being aluminum and unavoidable impurities. The patent also discusses a method of manufacturing a high strength aluminum alloy suitable for use in the manufacture of a fin, which comprises the step of heating an aluminum alloy ingot to 430–580° C., hot rolling the ingot to obtain a plate material, and applying a homogenizing annealing treatment at 250–350° C. for the stated purpose of causing intermetallic compounds to be distributed within the metal texture of the alloy.

U.S. Pat. No. 4,737,198 (Shabel) discloses a method of casting an alloy having components in the composition range of about 0.5–1.2% iron, 0.7–1.3% manganese, and 0–0.5% silicon by weight, homogenizing the cast alloy at temperatures below about 1100° F., preferably below about 1050° F. to control the microstructure, and cold rolling to a final gauge. The cold rolled alloy is then partially annealed to attain desired levels of strength and formability.

Japanese Patent No. 5-51710 proposes an aluminum foil annealed at 150–250° C. in a hot air furnace which carries the foil along on a hot air cushion at a temperature of 350–450° C. Japanese Patent No. 6-93397 discusses an aluminum alloy for making a foil and a treatment method to improve the properties of the foil, including cold rolling, heat treatment up to 400 C., and then process annealing at 250–450 C., followed by further cold rolling.

It is an object of the present invention to provide an improved method for producing aluminum alloy foil for heat exchanger fins based on continuous casting of an AA 1100 aluminum alloy.

DISCLOSURE OF THE INVENTION

The present invention provides a method for making an aluminum alloy foil for fins used in heat exchangers. The alloy may be an AA 1100 type aluminum alloy, such as an aluminum alloy containing about 0.27% to about 0.55% by weight of iron and about 0.06% to about 0.55% by weight of silicon.

The alloy also preferably contains about 0.05% to about 0.20% by weight copper. This alloy in molten form is continuously cast into an aluminum alloy strip, which continuously cast strip is cold rolled to a final gauge of about 0.076 mm to about 0.152 mm. The cold rolled strip is subjected to a partial annealing treatment at a temperature below about 260° C., with a maximum overheat of about 10° C. In this manner, the annealing of the aluminum alloy foil takes place with substantially no recrystallization.

The invention provides a strong yet formable improved aluminum alloy foil suitable for use in making fins for heat exchangers, including condensers and evaporators used in air conditioning equipment.

BEST MODES FOR CARRYING OUT THE INVENTION

It has been found that the difference between CC and DC cast material cannot be explained in terms of the alloy composition. For instance, aluminum alloys of various compositions including high and low Fe (0.27–0.55%), high and low silicon (0.06–0.55%), and changes in copper content (0.00–0.12%) were tried but the result was always the same. The CC cast material was less formable than the DC cast material. For example, the elongation of DC cast material when the yield strength is 96.5 MPa is around 22%. The corresponding yield strength at equivalent elongation for the CC cast material was around 48.3–62.1 MPa.

The difference between CC cast and DC cast material can be traced to the difference in the microstructure of the two partially annealed materials. During initial recrystallization, the DC cast material forms small grains but the CC cast material forms large grains. This may be due to the fact that fewer recrystallization sites are available in CC cast material due to the presence of these large grains rather than the bulk formability. This was unexpected, as it was always felt within the industry that the collar cracks were caused by inadequate elongation or Olsen values. This was only partially true. As long as the partially recrystallized material did not contain more than 5% of recrystallized grains, preferably not more than 2% of recrystallized grains, collar cracks did not form even when the elongation was only between 16–18%. Thus, for the CC material to adequately function in the fin-application, it was critical to prevent significant recrystallization of the material during the partial anneal.

Further, the presence of large grains in CC material could not only be correlated to the anneal temperature but also to the overheat provided in the furnace. Heat head, or overheat, is the difference between the metal and air or gas temperatures in the furnace. The air or gas temperature is measured directly by a thermocouple near the heat source and in the air flow in furnace and the metal temperature is generally measured by a thermocouple embedded within the coil in the furnace. For preventing recrystallization but allowing recovery to take place, the anneal temperature should not exceed 260° C., and preferably should be between 245–255° C. The overheat should not exceed 10° C., preferably should be less than 7° C. Under these circumstances, no recrystallization takes place. The anneal time is provided to finish recovery of the material. The low overheat imposed in the present method ensures the greatest possible uniformity of temperature during the anneal process and consequently the formation of even small amounts of recrystallized grains is prevented whilst operating at the highest possible temperature for recovery.

When the anneal practices referred to are followed, a CC cast material gives a microstructure that is essentially recovered and has very few, if any, recrystallized grains. The typical properties of such a material are shown in Table III below:

TABLE III

| | |
|---|---|
| Yield Strength (MPa) | 93.1–110.3 |
| Ultimate Tensile Strength (MPa) | 110.3–124.1 |
| Elongation % | 16–19 at 0.10 mm gauge |

Although the elongation of this material is significantly lower than the corresponding DC cast material, this material performs extremely well in fin applications.

During the formation of collars, aluminum is stretched by a significant extent. This depends upon the design of the collar. However, in a typical application, during the reflaring of the collar, the radial stretch could be as much as 20%. This is the main reason why cracks appear during reflaring. If large, recrystallized grains are present locally, then these grains stretch much more, being pliable compared to the rest of the material. Therefore, cracks appear even though the bulk properties could be excellent. By preventing recrystallization, and optimizing the anneal practice to give the maximum possible formability, collar cracks are prevented.

Currently, only DC cast material performs well in this application. By developing a CC cast alternative, the present invention provides a much more economical alternative.

The present invention includes continuously casting a Cu—Fe—Si—Al alloy and fabricating the alloy to a light gauge sheet or foil, e.g., sheet having approximately 0.076–0.152 mm thickness, followed by controlled partial annealing to achieve combinations of strength and formability not achieved by conventional techniques. The partial anneal is preferably carried out a batch anneal with the cold rolled sheet in coil form.

The preferred composition range for the alloy in accordance with the present invention is shown in Table IV below:

TABLE IV

| Elements | Wt % |
|---|---|
| Copper | 0.05% to 0.20% |
| Silicon | 0.36% to 0.44% |
| Iron | 0.39% to 0.47% |

(Balance aluminum with unavoidable impurities)

The silicon range of 0.3–0.5 wt % preferably 0.36–0.44 wt % and iron range of 0.3–0.5 wt % preferably 0.39–0.47% are chosen so that during the continuous casting process a single intermetallic species (alpha phase) is formed. Since the material does not undergo any subsequent homogenization process, this prevents the formation of surface rolling defects ("smut") during the cold rolling process.

Copper in the range given adds strength to the final product without causing excessive work hardening during the foil rolling stage.

The specified alloy is cast using a belt caster and in-line rolling mill to 1.7 mm gauge. The alloy is then cold rolled to the final product gauge. For fin stock applications, the final product gauge is in the range of about 0.076–0.152 mm. Partial annealing is then employed to optimize strength and formability. An example of the combined strength and formability that can be achieved for an annealing temperature of 250° C. is shown in Table V below.

TABLE V

| | |
|---|---|
| Yield Strength (MPa) | 100.0 |
| UTS (MPa) | 119.3 |
| Elong | 18.5 |
| Olsen | 5.7 mm |

Another example of the combined strength and formability that can be achieved for an annealing temperature of 248° C. is shown in Table VI below:

TABLE VI

| | |
|---|---|
| Yield Strength (MPa) | 111.0 |
| UTS (MPa) | 225.5 |
| Elong | 17.5 |
| Olsen | 5.8 mm |

The percentage of reflare cracks in both of the examples above were the same as in DC material at 0.5%. Only two rows of fin showed defects in both DC and CC material. Comparison of DC and CC material in the same rows of fins indicated that the number of defects were identical.

The process of the present invention has been found to develop a fine grained, high strength fin stock alloy with good formability. The alloy is particularly useful in producing light gauge sheet or foil for fin stock. The process of the present invention does not contain a hot rolling step preceded by a preheat at around 500° C.

The following example is intended to illustrate the practice of the claimed invention and is not to be construed as limiting.

EXAMPLE 1

An AA 1100 alloy of the following composition was cast using a belt caster and in-line rolling mill to 1.7 mm gauge. The composition range for the alloy is shown in Table VII below:

TABLE VII

| Elements | Wt % |
|---|---|
| Silicon | 0.42% |
| Iron | 0.41% |
| Copper | 0.06% |

These coils were then cold rolled to 0.10 mm gauge in three passes. The final coil was annealed with different annealing practices with a heat head of 50° C. The annealed coils were tested in fin presses and reflare cracks were counted and compared with a corresponding DC material (properties, yield strength 100.0 MPa, elongation 22%). The results are given in Table VIII below:

TABLE VIII

| | Anneal Practice | | | | | | | | Excess cracks |
|---|---|---|---|---|---|---|---|---|---|
| | Step 1 | | Step 2 | | UTS | YS | Elong | Olsen | over |
| Coil | Temp ° C. | Time | Temp ° C. | Time | MPa | MPa | % | mm | DC % |
| 1 | 235 | 2 | 258 | 6 | 119.8 | 92.8 | 18.0 | 6.0 | 14 |
| 2 | 235 | 2 | 262 | 6 | 110.3 | 75.2 | 22.0 | 6.1 | 41.6 |
| 3 | 235 | 2 | 262 | 6.5 | 106.1 | 63.4 | 20.5 | 6.4 | 52 |
| 4 | 235 | 2 | 262 | 6.5 | 101.3 | 52.4 | 21 | 7.0 | 58 |

As can be seen from the above data, the reflare cracks generally increased with increasing elongation and decreasing yield strength. When these samples were examined optically, the structure revealed presence of large grains that were partially recrystallized. On the other hand, the DC structure showed only very small grains, if any. The onset of large grains was probably caused by the high heat head which was maintained in the furnace and which caused a part of the coil to reach temperatures significantly higher than the target resulting in grain growth.

To avoid this and prevent any recrystallization, a new annealing practice was devised. This involved maintaining a very small heat head in the furnace, not exceeding 10° C. and preferably below 7° C. The annealing temperature was also brought down to avoid recrystallization altogether, as it was felt that this was the main reason for the poor performance of the CC material. The results are given in Table VIX below:

TABLE VIX

| | Anneal Practice | | Heat Head | UTS | YS | Elong | Olsen |
|---|---|---|---|---|---|---|---|
| Coil | Temp (° C.) | Time (hrs) | (° C.) | MPa | MPa | % | mm |
| 1 | 250 | 7 | 5 | 119.2 | 100.0 | 18.5 | 5.7 |
| 2 | 248 | 8 | 5 | 125.5 | 111.0 | 17.5 | 5.8 |

The percentage of reflare cracks were the same in DC material at 0.5%. Only two rows of fins showed defects in both DC and CC material. Comparison of DC and CC material in the same two rows of fins indicated that the number of defects were identical.

The invention claimed is:

1. A method of making collared aluminum alloy foil for use in heat exchanger fins, which method comprises (a) providing a molten aluminum-based alloy consisting essentially of 0.27% to 0.55% by weight iron, 0.06% to 0.55% silicon, optionally 0.05% to 0.20% copper and the balance aluminum and unavoidable impurities, (b) continuously casting said molten aluminum alloy into an aluminum alloy strip, (c) cold rolling the continuously cast aluminum alloy strip to a final gauge of about 0.076 mm to about 0.152 mm, and (d) forming at least one collar in said strip of final gauge and subjecting said collar to reflaring with radial stretching;

characterized by partially annealing the final gauge aluminum alloy strip, prior to said collar formation, at a temperature below about 260° C. with a maximum overheat of about 10° C. to thereby anneal the aluminum alloy foil while producing no more than 5% of recrystallized grains in the alloy.

2. A method according to claim 1, characterized in that the aluminum alloy contains 0.05% to 0.20% by weight copper.

3. A method according to claim 2, characterized in that the aluminum alloy contains 0.36% to 0.44% by weight iron and 0.39% to 0.47% by weight silicon.

4. A method according to claim 1, characterized in that the foil is partially annealed for a period of time of less than about 10 hours.

5. A method according to claim 1, characterized in that the foil is partially annealed at a temperature in the range of about 245° C. to 255° C.

6. A method according to claim 1, characterized in that the overheat during annealing is no more than about 7° C.

* * * * *